US009018152B2

(12) United States Patent
Ogura et al.

(10) Patent No.: US 9,018,152 B2
(45) Date of Patent: Apr. 28, 2015

(54) LIQUID DETERGENT COMPOSITION

(75) Inventors: Hirotsugu Ogura, Tokyo (JP); Hiroaki Shindo, Tokyo (JP)

(73) Assignee: LION Corporation (JP)

( * ) Notice: Subject to any disclaimer, the term of this patent is extended or adjusted under 35 U.S.C. 154(b) by 63 days.

(21) Appl. No.: 13/821,564

(22) PCT Filed: Sep. 12, 2011

(86) PCT No.: PCT/JP2011/070727

§ 371 (c)(1),
(2), (4) Date: Mar. 7, 2013

(87) PCT Pub. No.: WO2012/033222

PCT Pub. Date: Mar. 15, 2012

(65) Prior Publication Data

US 2013/0172227 A1 Jul. 4, 2013

(30) Foreign Application Priority Data

Sep. 10, 2010 (JP) ..... 2010-202886

(51) Int. Cl.

| | |
|---|---|
| ***C11D 1/02*** | (2006.01) |
| ***C11D 1/66*** | (2006.01) |
| ***C11D 3/386*** | (2006.01) |
| ***C11D 3/28*** | (2006.01) |
| ***C11D 3/34*** | (2006.01) |
| ***C11D 3/20*** | (2006.01) |
| ***C11D 3/33*** | (2006.01) |
| ***C11D 1/83*** | (2006.01) |

(52) U.S. Cl.

CPC ..... *C11D 3/38663* (2013.01); *C11D 3/38627* (2013.01); *C11D 3/2075* (2013.01); *C11D 1/66* (2013.01); *C11D 3/38645* (2013.01); *C11D 3/349* (2013.01); *C11D 1/02* (2013.01); *C11D 3/33* (2013.01); *C11D 3/34* (2013.01); *C11D 1/83* (2013.01); *C11D 3/38618* (2013.01)

(58) Field of Classification Search

CPC ..... C11D 1/02; C11D 1/66; C11D 1/83; C11D 3/2075; C11D 3/349; C11D 3/38618; C11D 3/38627; C11D 3/38645

USPC ..... 510/235, 321, 351, 356, 393, 422, 427, 510/488, 492, 499

See application file for complete search history.

(56) References Cited

U.S. PATENT DOCUMENTS

| | | | | |
|---|---|---|---|---|
| 4,608,189 | A | 8/1986 | Koch et al. | |
| 5,364,553 | A * | 11/1994 | Cao | 510/321 |
| 7,928,052 | B2 * | 4/2011 | Lenoir | 510/392 |
| 2003/0087787 | A1 * | 5/2003 | Man et al. | 510/392 |
| 2005/0020466 | A1 * | 1/2005 | Man et al. | 510/392 |
| 2006/0128588 | A1 * | 6/2006 | Lenoir | 510/392 |
| 2006/0247150 | A1 * | 11/2006 | Molinaro et al. | 510/499 |
| 2007/0179071 | A1 * | 8/2007 | Thoele | 510/161 |
| 2009/0281010 | A1 * | 11/2009 | Bastigkeit et al. | 510/102 |
| 2010/0093595 | A1 * | 4/2010 | Holzhauer et al. | 510/342 |
| 2010/0299846 | A1 * | 12/2010 | Holzhauer et al. | 8/137 |
| 2011/0166057 | A1 * | 7/2011 | Lenoir | 510/284 |
| 2011/0174340 | A1 * | 7/2011 | Choczaj et al. | 134/26 |

FOREIGN PATENT DOCUMENTS

| | | |
|---|---|---|
| JP | A-59-059799 | 4/1984 |
| JP | A-61-108387 | 5/1986 |
| JP | A-62-174299 | 7/1987 |
| JP | A-05-179291 | 7/1993 |
| JP | A-05-179292 | 7/1993 |
| JP | B-06-015038 | 3/1994 |
| JP | A-07-501349 | 2/1995 |
| JP | A-08-157872 | 6/1996 |
| JP | A-11-193398 | 7/1999 |
| JP | A-2000-017287 | 1/2000 |
| JP | A-2000-144179 | 5/2000 |
| JP | A-2002-146399 | 5/2002 |
| JP | A-2002-513563 | 5/2002 |
| JP | A-2002-167600 | 6/2002 |
| JP | A-2002-294284 | 10/2002 |
| JP | A-2004-027181 | 1/2004 |
| JP | A-2007-524744 | 8/2007 |
| JP | A-2008-161189 | 7/2008 |
| JP | A-2008-522625 | 7/2008 |
| JP | A-2009-138056 | 6/2009 |
| JP | A-2009-161591 | 7/2009 |
| JP | A-2011-094122 | 5/2011 |
| WO | WO 2009/082699 A1 | 7/2009 |

OTHER PUBLICATIONS

European Search Report for corresponding European Patent Application No. 11823690.0 (mailed Apr. 23, 2014).

International Search Report for corresponding International Patent Application No. PCT/JP2011/070727 (mailed Oct. 11, 2011).

Japanese Office Action for Japanese Patent Application No. 2012-533052 (mailed Feb. 10, 2015).

* cited by examiner

*Primary Examiner* — Gregory R Delcotto

(74) *Attorney, Agent, or Firm* — Merchant & Gould P.C.

(57) ABSTRACT

A liquid detergent composition containing (A) 10 to 70 mass % of a nonionic surfactant, (B) 1 to 15 mass % of an anionic surfactant, (C) 0.01 to 2 mass % of a protease, and (D) 0.001 to 0.1 mass % of at least one compound selected from the group consisting of thiazole-based compounds and sulfur-containing amino acids.

7 Claims, No Drawings

LIQUID DETERGENT COMPOSITION

This application is a U.S. National Stage Application under 35 U.S.C. §371 of International Patent Application No. PCT/JP2011/070727 filed 12 Sep. 2011, which claims the benefit of priority to Japanese Patent Application No. 2010-202886 filed 10 Sep. 2010, the disclosures of all of which are hereby incorporated by reference in their entireties. The International Application was published in Japanese on 15 Mar. 2012 as WO 2012/033222.

TECHNICAL FIELD

The present invention relates to a liquid detergent composition.

BACKGROUND

Detergent compositions used in laundering textile items such as clothing or fabrics typically contain a surfactant as a detergent component. Further, a variety of other additives are also added for the purpose of imparting various functions, including detergent builders such as alkaline agents, enzymes, hydrotropic agents, preservatives, antibacterial agents, fluorescent brightening agents, colorants, fragrances and antioxidants.

Among the various additives added to detergent compositions, enzymes are an important functional material, and are used as an additive that is capable of producing excellent detergency even under the severe laundering conditions (such as low temperature, low concentration, and short washing times) used in Japan.

Furthermore, in recent years, due to increased awareness of environmental issues, and also for design reasons, water-conserving drum-type washing machines are becoming increasingly popular for household washing machines. However, it has become evident that when laundering is performed using a typical household drum-type washing machine, because the liquor ratio (the ratio of the weight of wash liquid relative to the weight of items being laundered) is small, resoiling of the fibers tends to occur easily.

In order to enhance the anti-resoiling properties of liquid detergent compositions, a method that uses a specific nonionic surfactant (Patent Document 1), and a method that combines a specific nonionic surfactant, an anionic surfactant and an enzyme (Patent Document 2) and the like have been proposed.

On the other hand, in recent years, products have appeared in which enzymes have also been added to liquid detergent compositions, which are becoming increasingly popular as clothing detergents. However, the stability of enzymes in liquid detergent compositions is inferior to that of powdered detergent compositions, and a problem arises in that the enzyme activity is lost over time, making it impossible to achieve a satisfactory effect. This stability tends to be particularly problematic when the enzyme is used in combination with an anionic surfactant.

Numerous techniques for stabilizing enzymes added to liquid detergent compositions have been investigated, and methods that have been proposed include a method in which free calcium ions are added (Patent Document 3), a method in which a short-chain carboxylate such as a formate or a lactate is added (Patent Document 4), a method in which a specific polyol and boric acid or a derivative thereof are added (Patent Document 5), a method in which the ratio between a nonionic surfactant and an anionic surfactant, the pH, the degree of alkalinity and the water content and the like are set within specific ranges (Patent Document 6), and a method in which a (meth)acrylic acid/(meth)acrylic acid copolymer and a polyethylene glycol are added (Patent Document 7).

Besides these stabilization techniques, methods in which a reducing agent is added to improve the enzyme activity have also been proposed. For example, Patent Document 8 discloses a method in which an organic compound (such as an organic reducing agent) that cleaves disulfide bonds is added to a surfactant and a protease.

DOCUMENTS OF RELATED ART

Patent Documents

[Patent Document 1]
Japanese Unexamined Patent Application, First Publication No. 2004-27181
[Patent Document 2]
Japanese Unexamined Patent Application, First Publication No. 2009-161591
[Patent Document 3]
Japanese Unexamined Patent Application, First Publication No. Hei 5-179291
[Patent Document 4]
Japanese Unexamined Patent Application, First Publication No. Hei 5-179292
[Patent Document 5]
Published Japanese Translation of PCT, Publication No. Hei 7-501349
[Patent Document 6]
Japanese Unexamined Patent Application, First Publication No. Hei 8-157872
[Patent Document 7]
Japanese Unexamined Patent Application, First Publication No. Hei 11-193398
[Patent Document 8]
Japanese Unexamined Patent Application, First Publication No. 2000-17287

DISCLOSURE OF INVENTION

Problems to be Solved by the Invention

However, although each of the enzyme stabilization techniques mentioned above yields some effect, the stability of enzymes within liquid detergent compositions that also contain an anionic surfactant has still not reached a satisfactory level, and when storage tests that simulate long-term storage are performed, the enzyme activity sometimes deteriorates to a level that is unable to produce satisfactory performance. This problem is particularly prevalent for proteases.

The present invention has been developed in light of the above circumstances, and has an object of providing a liquid detergent composition which, even following long-term storage, exhibits a high level of protease activity and excellent anti-resoiling performance.

Means to Solve the Problems

As a result of intensive investigation, the inventors of the present invention discovered that in a liquid detergent composition containing (A) an nonionic surfactant, (B) an anionic surfactant, and (C) a protease, by ensuring that the amount of each of these components satisfies a specific range, and also adding a specific amount of (D) at least one compound selected from the group consisting of thiazole-based compounds and sulfur-containing amino acids, the above object could be achieved, and they were therefore able to complete the present invention.

The present invention that achieves the object described above has the aspects described below. In other words, a first aspect of the present invention is a liquid detergent composition containing (A) 10 to 70 mass % of a nonionic surfactant, (B) 1 to 15 mass % of an anionic surfactant, (C) 0.01 to 2 mass % of a protease, and (D) 0.001 to 0.1 mass % of at least one compound selected from the group consisting of thiazole-based compounds and sulfur-containing amino acids.

A second aspect of the present invention is the liquid detergent composition according to the first aspect, further containing (E) a calcium salt.

A third aspect of the present invention is the liquid detergent composition according to the first or second aspect, further containing (G) an α-hydroxy-monocarboxylic acid or a salt thereof.

A fourth aspect of the present invention is the liquid detergent composition according to the third aspect, wherein the component (G) is at least one compound selected from the group consisting of lactic acid and sodium lactate.

A fifth aspect of the present invention is the liquid detergent composition according to any one of the first to fourth aspects, further containing (F) at least one enzyme selected from the group consisting of cellulases and lipases.

The isothiazoline compounds of the component (D) (such as 5-chloro-2-methyl-4-isothiazolin-3-one and 2-methyl-4-isothiazolin-3-one) are the active ingredients within conventional preservatives and antibacterial agents, and are well known as components that can be added to liquid detergent compositions (for example, see Patent Documents 1 and 6). However, when used as a preservative or an antibacterial agent, the amount of the isothiazoline compound within the preservative or antibacterial agent is small, and when calculated relative to the total mass of the liquid detergent composition of the present invention, is approximately 0.0002 mass % or less. When added in this type of amount, a stabilization effect on the protease within the liquid detergent composition cannot be obtained.

Furthermore, Patent Document 8 discloses the use of a sulfur-containing amino acid such as cysteine or cystine as an organic reducing agent, and these organic reducing agents are known to cleave the disulfide bonds of protein soiling and improve the protein detergency provided by proteases. However, at the concentration levels required to achieve satisfactory manifestation of this effect (for example, 1 mass % relative to the total mass of the liquid detergent composition), the disulfide bonds of the protease within the liquid detergent composition are also cleaved, resulting in a deterioration in the stability of the protease. A protease stabilization effect is particularly difficult to obtain when an anionic surfactant also exists within the composition.

Effect of the Invention

The present invention is able to provide a liquid detergent composition which, even following long-term storage, exhibits a high level of protease activity and excellent anti-resoiling performance.

BEST MODE FOR CARRYING OUT THE INVENTION

The present invention is described below in detail.

The liquid detergent composition of the present invention contains predetermined amounts of components (A), (B), (C) and (D) described below.

The liquid detergent composition of the present invention preferably also contains a component (E) described below.

The liquid detergent composition of the present invention preferably also contains a component (F) described below.

[Component (A)]

The component (A) is a nonionic surfactant. The component (A) is added for the purpose of imparting detergency to the liquid detergent composition.

There are no particular limitations on the component (A), and conventional nonionic surfactants can be used. Examples of preferred compounds include nonionic surfactants represented by general formula (I) shown below (hereafter referred to as the nonionic surfactant (I)).

$$R^1—X—[(EO)_s/(PO)_t]—R^2 \quad (I)$$

In the formula, $R^1$ represents a hydrophobic group of 8 to 22 carbon atoms, X represents —O—, —CONH— or —COO—, EO represents an ethylene oxide group, s represents the average number of added moles of EO, PO represents a propylene oxide group, t represents the average number of added moles of PO, the EO and PO may be arranged randomly or in a block arrangement, $R^2$ represents a hydrogen atom, an alkyl group of 1 to 6 carbon atoms or an alkenyl group of 1 to 6 carbon atoms in those cases where X represents —O— or —CONH—, and represents an alkyl group of 1 to 6 carbon atoms or an alkenyl group of 1 to 6 carbon atoms in those cases where X represents —COO—.

The nonionic surfactant (I) is a so-called polyoxyalkylene nonionic surfactant, and is usually produced by adding either only ethylene oxide, or a predetermined ratio of ethylene oxide and propylene oxide, to a compound represented by a general formula:

$$R^1—X—R^2.$$

In formula (I), $R^1$ represents a hydrophobic group having 8 to 22 carbon atoms, and preferably 10 to 18 carbon atoms. Examples of the hydrophobic group include aliphatic hydrocarbon groups. The aliphatic hydrocarbon group may or may not have an unsaturated bond. The aliphatic hydrocarbon group may be linear or branched. The aliphatic hydrocarbon group is preferably a linear or branched alkyl group or alkenyl group.

The linear or branched alkyl group for $R^1$ is preferably a linear or branched alkyl group of 8 to 18 carbon atoms.

The linear or branched alkenyl group for $R^1$ is preferably a linear or branched alkenyl group of 8 to 18 carbon atoms.

X may be —O—, —CONH— or —COO—.

When X represents —O— or —CONH—, $R^2$ represents a hydrogen atom, an alkyl group of 1 to 6 carbon atoms or an alkenyl group of 1 to 6 carbon atoms, and is preferably a hydrogen atom, an alkyl group of 1 to 3 carbon atoms or an alkenyl group of 1 to 3 carbon atoms. When X represents —COO—, $R^2$ represents an alkyl group of 1 to 6 carbon atoms or an alkenyl group of 1 to 6 carbon atoms, and is preferably an alkyl group of 1 to 3 carbon atoms or an alkenyl group of 1 to 3 carbon atoms.

$R^1$, X and $R^2$ in formula (I) are derived from the raw material used for producing the component (A). For example, a nonionic surfactant (I) in which X represents —O— can be obtained using a raw material represented by $R^1$—O—$R^2$ (namely, an alcohol of 8 to 22 carbon atoms or an ether thereof). Further, a nonionic surfactant (I) in which X represents —CONH— can be obtained using a raw material represented by $R^1$—CONH—$R^2$ (namely, a fatty acid amide of 9 to 23 carbon atoms). Furthermore, a nonionic surfactant (I) in which X represents —COO— can be obtained using a raw material represented by $R^1$—COO—$R^2$ (namely, a fatty acid of 9 to 23 carbon atoms or an ester thereof).

EO represents ethylene oxide and PO represents propylene oxide.

s and t represent the average number of added moles of EO and PO respectively. The EO and PO may be arranged randomly or in blocks. The value of s is preferably from 3 to 20, and more preferably from 5 to 18. The value of t is preferably from 0 to 6, and more preferably from 0 to 3.

Provided the average number (s) of added moles of EO is 3 or more, the detergency improves. Further, when laundering is performed using this liquid detergent composition, the generation of odors on the laundered items can be effectively prevented. If s exceeds 20, then the HLB value becomes overly high, which is disadvantageous for laundering sebum, and there is a possibility that the detergency may deteriorate.

If the average number (t) of added moles of PO exceeds 6, then the storage stability of the liquid detergent composition under conditions of high temperature tends to deteriorate.

There are no particular limitations on the distribution of the number of added moles of EO or PO. This distribution of the number of added moles is prone to fluctuation depending on the reaction method used during production of the nonionic surfactant. For example, when the ethylene oxide or propylene oxide is added to the hydrophobic raw material using a typical alkali catalyst such as sodium hydroxide or potassium hydroxide, the distribution of the number of added moles of EO or PO tends to be a comparatively broad distribution. Further, when the ethylene oxide or propylene oxide is added to the hydrophobic raw material using a specific alkoxylated catalyst such as magnesium oxide containing added metal ions such as $Al^{3+}$, $Ga^{3+}$, $In^{3+}$, $Tl^{3+}$, $Co^{3+}$, $Sc^{3+}$, $La^{3+}$ or $Mn^{2+}$, as disclosed in Japanese Examined Patent Application, Second Publication No. Hei 6-15038, the distribution of the number of added moles of EO or PO tends to be a comparatively narrow distribution. The average number of added moles can be measured easily, for example by performing high performance liquid chromatography (HPLC) using a Zorbax C8 column (manufactured by DuPont Corporation) and using a mixed solvent of acetonitrile and water as the mobile phase, and indicates the number of added moles within the compound that exists at the largest mass % among the total mass of nonionic surfactants represented by formula (I).

Among the various compounds described above, the nonionic surfactant (I) is preferably a nonionic surfactant in which X within formula (I) is either —O— or —COO—.

When X in formula (I) represents —O—, $R^2$ is preferably a hydrogen atom. In the following description, a nonionic surfactant of formula (I) in which X represents —O— and $R^2$ is a hydrogen atom may also be referred to as an alcohol ethoxylate.

When the nonionic surfactant (I) is an alcohol ethoxylate, $R^1$ is preferably a linear or branched alkyl group or alkenyl group, and the group preferably contains 10 to 22 carbon atoms, more preferably 10 to 20 carbon atoms, and still more preferably 10 to 18 carbon atoms. Alcohol ethoxylates prepared using a primary or secondary alcohol as the raw material are particularly desirable. In other words, alcohol ethoxylates in which $R^1$ represents a primary or secondary hydrocarbon group and $R^2$ represents a hydrogen atom are preferable. When X in formula (I) is —COO—, $R^2$ represents an alkyl group of 1 to 6 carbon atoms or an alkenyl group of 1 to 6 carbon atoms. In the following description, a nonionic surfactant of formula (I) in which X represents —COO— and $R^2$ is an alkyl group of 1 to 6 carbon atoms or an alkenyl group of 1 to 6 carbon atoms may also be referred to as a fatty acid ester nonionic surfactant. $R^2$ is preferably an alkyl group of 1 to 3 carbon atoms or an alkenyl group of 1 to 3 carbon atoms, and more preferably an alkyl group of 1 to 3 carbon atoms.

When the nonionic surfactant (I) is a fatty acid ester nonionic surfactant, $R^1$ is preferably a linear or branched alkyl group or alkenyl group, and the group preferably contains 9 to 21 carbon atoms, and more preferably 10 to 21 carbon atoms.

Specific examples of the nonionic surfactant (I) include nonionic surfactants obtained by adding 12 molar equivalents or 15 molar equivalents of ethylene oxide to an alcohol such as a product Diadol (C13) (wherein C represents the carbon number, this also applies below) manufactured by Mitsubishi Chemical Corporation, a product Neodol (C12/C13) manufactured by Royal Dutch Shell plc, or a product Safol 23 (C12/C13) manufactured by Sasol Ltd.; nonionic surfactants obtained by adding 12 molar equivalents or 15 molar equivalents of ethylene oxide to a natural alcohol such as the products CO-1214 and CO-1270 manufactured by P&G Company; a nonionic surfactant obtained by adding 7 molar equivalents of ethylene oxide to a C13 alcohol obtained by subjecting a C12 alkene obtained by trimerizing butene to the oxo process (namely, the nonionic surfactant Lutensol T07, manufactured by BASF Corporation); a nonionic surfactant obtained by adding 7 molar equivalents of ethylene oxide to a C10 alcohol obtained by subjecting pentanol to the Guerbet reaction (namely, the nonionic surfactant Lutensol XL70, manufactured by BASF Corporation); a nonionic surfactant obtained by adding 6 molar equivalents of ethylene oxide to a C10 alcohol obtained by subjecting pentanol to the Guerbet reaction (namely, the nonionic surfactant Lutensol XA60, manufactured by BASF Corporation); nonionic surfactants obtained by adding 9 molar equivalents or 15 molar equivalents of ethylene oxide to a secondary alcohol having a carbon number of 12 to 14 (namely, the products Softanol 90 and Softanol 150, manufactured by Nippon Shokubai Co., Ltd.); and a nonionic surfactant obtained by adding 15 molar equivalents of ethylene oxide to coconut fatty acid methyl ester (lauric acid/myristic acid=8/2) using an alkoxylation catalyst (namely, the nonionic surfactant polyoxyethylene coconut fatty acid methyl ester, EO 15 mol adduct).

Nonionic surfactants other than the nonionic surfactant (I) may also be used as the component (A). Examples of these other nonionic surfactants include alkylene oxide adducts of alkylphenols, higher fatty acids and higher amines, polyoxyethylene polyoxypropylene block copolymers, fatty acid alkanolamines, fatty acid alkanolamides, polyhydric alcohol fatty acid esters and alkylene oxide adducts thereof, polyhydric alcohol fatty acid ethers, alkyl (or alkenyl) amine oxides, alkylene oxide adducts of hardened castor oil, sugar fatty acid esters, N-alkyl polyhydroxy fatty acid amides, alkyl glycosides, and alkyl polyglyceryl ethers.

As the component (A), either a single type of nonionic surfactant may be used alone, or a combination of a plurality of different nonionic surfactants may be used.

In those cases where the total amount of surfactants within the liquid detergent composition of the present invention (namely, the combination of the component (A), the component (B) and any other optionally added surfactants) represents at least 50 mass % of the total mass of the liquid detergent composition, it is preferable that the component (A) is a nonionic surfactant that has a small gel region even at high concentration. Examples of this type of nonionic surfactant include secondary alcohol ethoxylates and polyoxyethylene fatty acid alkyl esters.

Examples of the secondary alcohol ethoxylates include compounds of the aforementioned formula (I) in which $R^1$ is a hydrocarbon group derived from a secondary alcohol (such as a secondary alkyl group or secondary alkenyl group) and $R^2$ is a hydrogen atom, and specific examples include the Softanol series of products, which are produced by adding ethylene oxide to a secondary alcohol.

Examples of the polyoxyethylene fatty acid alkyl esters include compounds of the aforementioned formula (I) in which $R^1$ is a hydrocarbon group derived from a fatty acid (such as an alkyl group or alkenyl group) and $R^2$ is an alkyl group of 1 to 3 carbon atoms, and specific examples include polyoxyethylene fatty acid methyl esters (hereafter sometimes abbreviated as "MEE").

Particularly in those cases where two types of nonionic surfactants are combined as the component (A), from the viewpoints of gelling of the composition upon dilution and usability of the composition, it is preferable to use a combination of an aforementioned secondary alcohol ethoxylate or MEE, and a primary alcohol ethoxylate (a compound of the aforementioned formula (I) in which $R^1$ is a hydrocarbon group derived from a primary alcohol (such as a primary alkyl group or primary alkenyl group) and $R^2$ is a hydrogen atom). In such a case, the mass ratio between the two components (secondary alcohol ethoxylate or MEE/primary alcohol ethoxylate) is preferably within a range from 3/7 to 10/0, more preferably from 5/5 to 10/0, and still more preferably from 7/3 to 10/0.

The amount of the component (A), relative to the total mass of the liquid detergent composition, is typically within a range from 10 to 70 mass %, preferably from 20 to 70 mass %, and more preferably from 25 to 55 mass %. By ensuring that the amount of the component (A) satisfies the above range, the effects of the present invention can be achieved more easily. Provided the amount of the component (A) is at least 10 mass %, the liquid detergent composition can be imparted with satisfactory detergency. On the other hand, provided the amount of the component (A) is not more than 70 mass %, the storage stability of the component (C) is excellent, powerful enzyme activity is maintained even after long-term storage, and superior anti-resoiling performance is obtained. In particular, if the amount of the component (A) is within a range from 25 to 55 mass %, then the component (D) functions efficiently, resulting in better stabilization of the component (C).

[Component (B)]

The component (B) is an anionic surfactant.

There are no particular limitations on the component (B), and any surfactant selected appropriately from among conventional anionic surfactants may be used.

Examples of anionic surfactants that can be used favorably as the component (B) in the present invention include linear alkylbenzene sulfonic acids or salts thereof, α-olefin sulfonates, linear or branched alkyl sulfate ester salts, alkyl ether sulfate ester salts or alkenyl ether sulfate ester salts, alkane sulfonates having an alkyl group, and α-sulfo fatty acid ester salts. Examples of the salts within these anionic surfactants include salts of alkali metals such as sodium and potassium, salts of alkaline earth metals such as magnesium, and salts of alkanolamines such as monoethanolamine and diethanolamine.

Among the above anionic surfactants, in the linear alkylbenzene sulfonic acid or salt thereof, the linear alkyl group preferably contains 8 to 16 carbon atoms, and more preferably 10 to 14 carbon atoms.

The α-olefin sulfonate is preferably an α-olefin sulfonate of 10 to 20 carbon atoms.

The alkyl sulfate ester salt is preferably an alkyl sulfate ester salt containing an alkyl group of 10 to 20 carbon atoms.

The alkyl ether sulfate ester salt or alkenyl ether sulfate ester salt has a linear or branched alkyl group or alkenyl group of 10 to 20 carbon atoms, and is preferably an alkyl ether sulfate ester salt or alkenyl ether sulfate ester salt to which an average of 1 to 10 moles of ethylene oxide have been added (namely, a polyoxyethylene alkyl ether sulfate ester salt or a polyoxyethylene alkenyl ether sulfate ester salt).

The alkane sulfonate is preferably an alkane sulfonate containing an alkyl group of 10 to 20 carbon atoms, and an alkane sulfonate of 14 to 17 carbon atoms is particularly desirable. Among such compounds, alkane sulfonates in which the alkyl group is a secondary alkyl group (namely, secondary alkane sulfonates) are particularly desirable.

The α-sulfo fatty acid ester salt is preferably an α-sulfo fatty acid ester salt in which the fatty acid residue contains 10 to 20 carbon atoms.

Among the above compounds, it is particularly desirable to use at least one anionic surfactant selected from the group consisting of linear alkylbenzene sulfonic acids and salts thereof, alkane sulfonates, polyoxyethylene alkyl ether sulfate ester salts and α-olefin sulfonates.

Other anionic surfactants besides those described above may also be used as the component (B). Examples of these other anionic surfactants include higher fatty acid salts of 10 to 20 carbon atoms, alkyl ether carboxylates, polyoxyalkylene ether carboxylates, alkyl (or alkenyl) amide ether carboxylates, carboxylic acid-based anionic surfactants such as acylaminocarboxylates, alkyl phosphate ester salts, polyoxyalkylene alkyl phosphate ester salts, polyoxyalkylene alkylphenyl phosphate ester salts, and phosphate ester-based anionic surfactants such as glycerol fatty acid ester monophosphate ester salts.

These anionic surfactants are readily available commercially.

As the component (B), either a single type of anionic surfactant may be used alone, or a combination of a plurality of different anionic surfactants may be used.

The amount of the component (B), relative to the total mass of the liquid detergent composition, is typically within a range from 1 to 15 mass %, preferably from 2 to 10 mass %, and more preferably from 2 to 6 mass %. Provided the amount of the component (B) is at least 1 mass %, the liquid detergent composition can be imparted with a satisfactory anti-resoiling effect and favorable detergency. On the other hand, provided the amount of the component (B) is not more than 15 mass %, the storage stability of the component (C) is excellent, powerful enzyme activity is maintained even after long-term storage, and superior anti-resoiling performance is obtained.

Further, in the liquid detergent composition, the combined amount of the component (A) and the component (B), relative to the total mass of the liquid detergent composition, is preferably within a range from 11 to 70 mass %, more preferably from 20 to 50 mass %, and still more preferably from 30 to 40 mass %. Provided the combined amount of the component (A) and the component (B) is at least 11 mass %, the liquid detergent composition can be imparted with satisfactory detergency and a favorable anti-resoiling effect. On the other hand, provided the combined amount of the component (A) and the component (B) is not more than 70 mass %, the storage stability of the component (C) is excellent, powerful enzyme activity is maintained even after long-term storage, and superior anti-resoiling performance is obtained.

In the liquid detergent composition, there are no particular limitations on the blend ratio (mass ratio) between the component (A) and the component (B), but the value of component (B)/component (A) is preferably within a range from 0.02 to 0.8, more preferably from 0.05 to 0.5, and still more preferably from 0.1 to 0.5. Provided the value of component (B)/component (A) satisfies the above range, the storage stability of the component (C) is excellent, powerful enzyme activity is maintained even after long-term storage, and superior anti-resoiling performance is obtained.

[Component (C)]

The component (C) is a protease.

The component (C) in the present invention preferably has a histidine at or near the active center, such as serine protease, and more preferably has serine, histidine and aspartic acid. When the component (C) has this type of structure, the component (D) described below is able to bond to the active center of the component (C).

During laundering, the component (C) decomposes protein soiling which can act as a binder for resoiling, and can therefore inhibit the resoiling of cotton and chemical fibers such as polyester.

The component (C) is available commercially as a pharmaceutical preparation (protease preparation), and the liquid detergent composition is usually prepared using this type of protease preparation.

Specific examples of protease preparations include serine proteases available from Novozymes A/S under the brand names Savinase 16L, Savinase Ultra 16L, Savinase Ultra 16XL, Everlase 16L Type EX, Everlase Ultra 16L, Esperase 8L, Alcalase 2.5L, Alcalase Ultra 2.5L, Liquanase 2.5L, Liquanase Ultra 2.5L, Liquanase Ultra 2.5XL and Coronase 48L, and proteases available from Genencor International BV under the brand names Purafect L, Purafect OX and Properase L. Any one of these proteases may be used alone, or a combination of two or more proteases may be used.

The amount of the component (C), relative to the total mass of the liquid detergent composition, is typically within a range from 0.01 to 2.0 mass %, preferably from 0.1 to 2.0 mass %, more preferably from 0.2 to 1.0 mass %, and still more preferably from 0.4 to 0.8 mass %. By ensuring that the amount of the component (C) is at least as large as the lower limit of the above range, the effect of adding the component (C) can be achieved satisfactorily. If the amount of the component (C) exceeds the upper limit of the above range, then the effect reaches saturation level and becomes economically unviable, and there is also a possibility that the component (C) may precipitate during storage, resulting in a deterioration in the storage stability of the component (C).

In the present description and the claims, the amount of an enzyme (namely, the component (C) or the component (F) described below and the like) within the liquid detergent composition refers to the amount as the preparation, and conventional methods can be used to calculate the amount of raw material used, or the amount of the enzyme preparation can be determined by back calculation from the amount of enzyme protein within the liquid detergent composition.

[Component (D)]

The component (D) is at least one compound selected from the group consisting of thiazole-based compounds and sulfur-containing amino acids.

The component (B) destroys the active center of the component (C), and in particular breaks the ionic bonds at the active center of the component (C), thus causing deactivation of the component (C). It is thought that the component (D) bonds to the active center of the component (C), thereby protecting the active center of the component (C), inhibiting autolysis of the component (C) and protein denaturation from the active center, and effectively suppressing any deterioration in the protease activity. Moreover, it is assumed that because the component (D) bonds specifically to the active center of the component (C), it contributes to enzyme stability even at very low concentrations. To provide a specific example, a serine protease widely used in detergent compositions for clothing contains serine, histidine and aspartic acid amino acid residues at the active center, and it is thought that the component (D) protects the active center by bonding to the imidazoyl group of the histidine residue, thereby efficiently inhibiting any deterioration in the activity of the component (C).

Further, by adding the component (D), if other enzymes (such as cellulase or lipase) are added in addition to the component (C), then deterioration in the activity of these other enzymes besides the component (C) is also suppressed, enabling favorable enzyme activity to be maintained even after storage.

Conventionally known thiazole-based compounds and sulfur-containing amino acids can be used as the thiazole-based compound and the sulfur-containing amino acid respectively.

Examples of preferred thiazole-based compounds include:

isothiazolone-based compounds such as 5-chloro-2-methyl-4-isothiazolin-3-one, 2-methyl-4-isothiazolin-3-one, 2-n-octyl-4-isothiazolin-3-one, 4,5-dichloro-2-n-octyl-4-isothiazolin-3-one, 2-ethyl-4-isothiazolin-3-one, 4,5-dichloro-2-cyclohexyl-4-isothiazolin-3-one, 5-chloro-2-ethyl-4-isothiazolin-3-one, 5-chloro-2-t-octyl-4-isothiazolin-3-one, and 1,2-benzoisothiazolin-3-one;

thiazolidinedione-based compounds such as 2,4-thiazolidinedione, 3-methyl-1,3-thiazolidine-2,4-dione, and 5-(4-amino-3-methoxybenzyl)-2,4-thiazolidinedione; and thiamine-based compounds such as 3-((4-amino-2-methylpyrimidin-5-yl)methyl)-5-(2-hydroxyethyl)-4-methylthiazol-3-ium chloride, 5-(2-hydroxyethyl)-3-((4-hydroxy-2-methyl-5-pyrimidinyl)methyl)-4-methylthiazol-3-ium chloride, 3-(((1,4-dihydro-2-methyl-4-oxopyrimidin)-5-yl)methyl)-5-(2-hydroxyethyl)-4-methylthiazol-3-ium chloride, and 5-(2-hydroxyethyl)-3-((4-hydroxy-2-methyl-5-pyrimidinyl)methyl)-4-methylthiazol-3-ium chloride.

Among these compounds, at least one compound selected from the group consisting of 5-chloro-2-methyl-4-isothiazolin-3-one, 2-methyl-4-isothiazolin-3-one, 1,2-benzoisothiazolin-3-one, 2,4-thiazolidinedione and 3-((4-amino-2-methylpyrimidin-5-yl)methyl)-5-(2-hydroxyethyl)-4-methylthiazol-3-ium chloride is preferable, and at least one compound selected from the group consisting of 1,2-benzoisothiazolin-3-one and 3-((4-amino-2-methylpyrimidin-5-yl)methyl)-5-(2-hydroxyethyl)-4-methylthiazol-3-ium chloride is particularly desirable.

The sulfur-containing amino acid may be a naturally occurring sulfur-containing amino acid or a sulfur-containing amino acid obtained by synthesis. Examples of naturally occurring sulfur-containing amino acids include cysteine, methionine, cystine and glutathione.

Among the above amino acids, the sulfur-containing amino acid is preferably cysteine or methionine, and is most preferably cysteine.

As the component (D), a single type of compound may be used alone, or a combination of two or more different compounds may be used. For example, a thiazole-based compound may be used alone, a sulfur-containing amino acid may be used alone, or a combination of the two may be used. Further, the thiazole-based compound or the sulfur-containing amino acid may be either a single compound or a combination of two or more compounds.

In terms of storage stability affected the precipitation of the liquid detergent composition during low-temperature storage, the component (D) is preferably a thiazole-based compound, more preferably an isothiazolone-based compound, and most preferably 1,2-benzoisothiazolin-3-one, 5-chloro-2-methyl-4-isothiazolin-3-one or 2-methyl-4-isothiazolin-3-one.

The amount of the component (D), relative to the total mass of the liquid detergent composition, is typically within a range from 0.001 to 0.1 mass %, preferably from 0.01 to 0.05 mass %, and more preferably from 0.01 to 0.03 mass %. Provided the amount of the component (D) is at least 0.001 mass %, the effect of the component (D) in improving the stability of the component (C) can be achieved satisfactorily. If the amount of the component (D) exceeds 0.1 mass %, then the effect reaches saturation level and becomes economically unviable, and particularly in those cases where the total amount of surfactants exceeds 50 mass % of the composition, there is also a possibility that the liquid stability of the liquid detergent composition may deteriorate, with an increased likelihood of problems such as precipitation of the surfactant(s) during storage.

Although there are no particular limitations on the blend ratio (mass ratio) between the component (C) and the component (D), in terms of achieving a superior stabilization effect on the component (C), the mass ratio of component (D)/component (C) is preferably within a range from 0.001 to 5, more preferably from 0.01 to 1, still more preferably from 0.02 to 0.2, and most preferably from 0.05 to 0.1.

[Component (E)]

The component (E) is a calcium salt. In the liquid detergent composition, the component (E) exists in a state where at least some of the component dissolves to form ions (namely, calcium ions and counter ions).

By including the component (E), the storage stability of the component (C) can be further improved. Particularly in those cases where a metal ion scavenger described below (such as citric acid) is added to the liquid detergent composition, because the metal ion scavenger can trap the calcium within the protease molecule, causing deactivation of the component (C), supplying calcium ions by adding the component (E) can inhibit this deactivation.

Any component that releases calcium ions upon dissolution in water can be used as the component (E), and any arbitrary water-soluble calcium salt can be used. Specific examples include calcium chloride, calcium gluconate, calcium lactate, calcium formate and calcium acetate. Among these, from the viewpoints of solubility in water and economic viability, calcium chloride is preferable.

The term "water-soluble" used in describing a water-soluble calcium salt means the solubility of the salt in water at 20° C. is at least 1 g/100 ml.

As the component (E), either a single salt may be used alone, or a combination of two or more different salts may be used.

When the component (E) is added, the amount of the component (E) is preferably sufficient to generate a molar concentration (mmol/L) of calcium ions within 1 L of the liquid detergent composition of 0.1 to 15 mmol/L, and more preferably 0.5 to 3 mmol/L. Provided the amount of the component (E) yields a molar concentration at least as large as the lower limit of the above range, the effects obtained by adding the component (E) can be achieved satisfactorily, and provided the molar concentration is not more than the upper limit of the above range, the liquid stability of the liquid detergent composition is improved.

[Component (F)]

The component (F) is at least one enzyme selected from the group consisting of cellulases and lipases. Because cellulases decompose and remove amorphous sections within cotton fibers, they can inhibit the resoiling of cotton, and generate an anti-resoiling effect synergistically with the component (C). Lipases decompose oil-based soiling, and can therefore inhibit the resoiling of chemical fibers such as polyester, generating an anti-resoiling effect synergistically with the component (C). Cellulases and lipases are available commercially as preparations (cellulase preparations and lipase preparations), and the liquid detergent composition is usually prepared using these types of preparations.

Specific examples of cellulase preparations include preparations available from Novozymes A/S under the brand names Endolase 5000L, Celluzyme 0.4L and Carzyme 4500L, and preparations available from Genencor International BV under the brand name Puradax.

Specific examples of lipase preparations include preparations available from Novozymes A/S under the brand names Lipex 100L and Lipolase 100L.

Among the above preparations, the component (F) is preferably Endolase 5000L or Lipex 100L, and is most preferably Endolase 5000L.

As the component (F), either a single type of nonionic surfactant may be used alone, or a combination of two or more different nonionic surfactants may be used.

When the component (F) is added, the amount of the component (F), relative to the total mass of the liquid detergent composition, is preferably within a range from 0.01 to 2.0 mass %, more preferably from 0.1 to 2.0 mass %, still more preferably from 0.2 to 1.0 mass %, and most preferably from 0.4 to 0.8 mass %. By ensuring that the amount of the component (F) is at least as large as the lower limit of the above range, the effect of adding the component (F) can be achieved satisfactorily. If the amount of the component (F) exceeds the upper limit of the above range, then the effect reaches saturation level and becomes economically unviable, and there is also a possibility that the component (F) may precipitate during storage, resulting in a deterioration in the liquid stability of the liquid detergent composition.

[Component (G)]

The component (G) is an α-hydroxy-monocarboxylic acid or a salt thereof.

The α-hydroxy-monocarboxylic acid or salt thereof describes an α-hydroxy-monocarboxylic acid or a salt of such an α-hydroxy-monocarboxylic acid.

It is thought that the component (G) adsorbs to the surface of the component (C), and has a role in maintaining the structure of the component (C) (namely, protecting the structure from external attack), thus enhancing the stability of the component (C) in combination with the component (D).

The α-hydroxy-monocarboxylic acid is preferably a compound represented by general formula (g1) shown below.

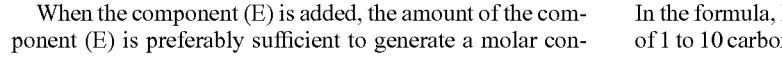

$$R—C(OH)(R')—COOH \quad (g1)$$

In the formula, R represents a hydrogen atom, an alkyl group of 1 to 10 carbon atoms which may have a substituent, an aryl group of 1 to 6 carbon atoms which may have a substituent, a nitro group, an ester group of 1 to 6 carbon atoms, an ether group of 1 to 6 carbon atoms, an amino group which may have a substituent, or an amine-derived group; R' represents a hydrogen atom, an alkyl group of 1 to 10 carbon atoms which may have a substituent, an aryl group of 1 to 6 carbon atoms which may have a substituent, a nitro group, an ester group of 1 to 6 carbon atoms, an ether group of 1 to 6 carbon atoms, an amino group which may have a substituent, or an amine-derived group.

In formula (g1), examples of the substituent with which the alkyl group or aryl group for R and R' may be substituted include an aryl group of 1 to 6 carbon atoms, an alkyl group of 1 to 6 carbon atoms, a nitro group, a nitro-derived group, a hydroxyl group, an ester group of 1 to 6 carbon atoms, an ether group of 1 to 6 carbon atoms, an amino group which may have a substituent, an amine-derived group, an amide group, an amide-derived group and a halogen atom.

Examples of the aforementioned amino which may have a substituent include an ethylamino group, propylamino group, isopropylamino group, butylamino group, t-butylamino group, benzylamino group, phenylamino group and pyridylamino group. Examples of the salt of the α-hydroxy-monocarboxylic acid include alkali metal salts such as sodium salts and potassium salts, alkaline earth metal salts such as calcium salts and magnesium salts, ammonium salts, and alkanolamine salts such as ethanolamine salts.

The component (G) is preferably at least one component selected from the group consisting of glycolic acid, lactic acid, hydroxybutyric acid, hydroxyisobutyric acid, mandelic acid, optical isomers of these acids, and salts thereof, is more preferably at least one component selected from the group consisting of mandelic acid, lactic acid and salts thereof, and is most preferably at least one component selected from the group consisting of lactic acid and salts thereof. The lactic acid salt is preferably sodium lactate.

As the component (G), either a single compound may be used alone, or a combination of two or more different compounds may be used.

The amount of the component (G), relative to the total mass of the liquid detergent composition, is preferably within a range from 0.1 to 5 mass %, more preferably from 0.15 to 2 mass %, and still more preferably from 0.2 to 1.5 mass %. By ensuring that the amount of the component (G) satisfies the range from 0.1 to 5 mass %, the component (G) can adsorb favorably to the surface of the component (C), thereby enhancing the stability of the component (C) within the preparation.

On the other hand, if the amount of the component (G) is less than 0.1 mass %, then the stabilizing effect on the component (C) may be inadequate. Further, if the amount of the component (G) exceeds 5 mass %, then precipitation may occur upon production of the preparation.

[Water]

From the viewpoints of ease of preparation of the liquid detergent composition, achieving good solubility in water upon use as a detergent composition, and improving the stabilization of the component (C) by the component (D), the liquid detergent composition of the present invention preferably also contains water.

The amount of water within the liquid detergent composition, relative to the total mass of the liquid detergent composition, is preferably within a range from 20 to 80 mass %, more preferably from 30 to 70 mass %, and still more preferably from 40 to 60 mass %. Provided the amount of water satisfies the above range, the stabilization effect on the component (C) provided by the component (D) can be achieved satisfactorily. Further, provided the amount of water is at least as large as the lower limit of the above range, the liquid detergent composition can be imparted with satisfactory detergency. If the amount of water exceeds the upper limit of the above range, then the liquid stability of the liquid detergent composition may deteriorate, with an increased likelihood of problems such as precipitation of the component (C) during storage.

[Other Components]

Other components besides the components (A) to (F) described above may also be added to the liquid detergent composition of the present invention according to need, provided they do not impair the effects of the present invention.

There are no particular limitations on these other components, and the types of components typically used in liquid detergent compositions may be added, including the components described below.

(Cationic Surfactants)

There are no particular limitations on the cationic surfactants that may be used, which may be selected appropriately from among conventional cationic surfactants. Specific examples include cationic surfactants such as alkyltrimethylammonium salts, dialkyldimethylammonium salts, alkylbenzyldimethylammonium salts and alkylpyridinium salts.

(Amphoteric Surfactants)

There are no particular limitations on the amphoteric surfactants that may be used, which may be selected appropriately from among conventional amphoteric surfactants. Specific examples include amphoteric surfactants such as alkyl betaine-type, alkylamide betaine-type, imidazoline-type, alkylamino sulfonate-type, alkylamino carboxylate-type, alkylamide carboxylate-type, amidoamino acid-type and phosphate-type amphoteric surfactants.

(Water-Miscible Organic Solvents)

Any organic solvent that forms a uniform solution when mixed with water can be used as a water-miscible organic solvent, and specific examples include alcohols such as ethanol, 1-propanol, 2-propanol and 1-butanol, glycols such as propylene glycol, butylene glycol and hexylene glycol, polyglycols such as diethylene glycol, triethylene glycol, tetraethylene glycol, polyethylene glycols having an average molecular weight of approximately 200 to 1,000 and dipropylene glycol, and alkyl ethers such as diethylene glycol monomethyl ether and diethylene glycol dimethyl ether.

The amount of the water-miscible organic solvent within the liquid detergent composition, relative to the total mass of the liquid detergent composition, is preferably from 0.1 to 15 mass %.

(Viscosity Reducers or Solubilizers)

Viscosity reducers or solubilizers are components that are added to the liquid detergent composition to inhibit gelling of the liquid detergent composition at the liquid surface of the composition, resulting in formation of a film, and examples of such components include aromatic sulfonic acids and salts thereof. Specific examples include toluenesulfonic acid, xylenesulfonic acid, cumenesulfonic acid, substituted or unsubstituted naphthalenesulfonic acid, toluenesulfonate salts, xylenesulfonate salts, cumenesulfonate salts, and substituted or unsubstituted naphthalenesulfonate salts. Examples of the salts include sodium salts, potassium salts, calcium salts, magnesium salts, ammonium salts and alkanolamine salts.

A single viscosity reducer or solubilizer may be used alone, or a combination of two or more viscosity reducers or solubilizers may be used as a mixture.

The amount of the viscosity reducer or solubilizer within the liquid detergent composition, relative to the total mass of the liquid detergent composition, is preferably from 0.01 to 15 mass %. Provided the amount of the viscosity reducer or solubilizer satisfies this range, the inhibitory effect that suppresses formation of a film at the liquid surface of the liquid detergent composition can be enhanced.

(Alkaline Agent)

Examples of the alkaline agent include alkanolamines such as monoethanolamine, diethanolamine and triethanolamine.

A single alkaline agent may be used alone, or a combination of two or more alkaline agents may be used as a mixture.

The amount of the alkaline agent within the liquid detergent composition, relative to the total mass of the liquid detergent composition, is preferably from 0.5 to 5 mass %.

(Metal Ion Scavengers)

Examples of metal ion scavengers include malonic acid, succinic acid, malic acid, diglycolic acid, tartaric acid and citric acid.

A single metal ion scavenger may be used alone, or a combination of two or more metal ion scavengers may be used as a mixture.

When a metal ion scavenger is added, the amount of the metal ion scavenger, relative to the total mass of the liquid detergent composition, is preferably from 0.1 to 20 mass %.

(Antioxidants)

There are no particular limitations on the antioxidant, but in terms of achieving favorable detergency and liquid stability, phenol-based antioxidants are preferred. The phenol-based antioxidant is preferably dibutylhydroxytoluene, butylhydroxyanisole, 2,2'-methylenebis(4-methyl-6-t-butylphenol) or dl-α-tocopherol, and more preferably dibutylhydroxytoluene or dl-α-tocopherol.

A single antioxidant may be used alone, or a combination of two or more antioxidants may be used as a mixture.

The amount of the antioxidant, relative to the total mass of the liquid detergent composition, is preferably from 0.01 to 2 mass %.

(Texture Improvers)

A silicone such as a dimethylsilicone, polyether-modified silicone or amino-modified silicone may be added to the liquid detergent composition for the purpose of improving the texture.

The amount added of the texture improver, relative to the total mass of the liquid detergent composition, is preferably from 0 to 5 mass %.

(Fluorescent Brighteners)

A distyrylbiphenyl-based fluorescent brightener may be added to the liquid detergent composition for the purpose of improving the whiteness of white clothing.

The amount added of the fluorescent brightener, relative to the total mass of the liquid detergent composition, is preferably from 0 to 1 mass %.

(Anti-Resoiling Agents)

An anti-resoiling agent such as polyvinylpyrrolidone or carboxymethyl cellulose may be added to the liquid detergent composition for the purposes of preventing color migration and resoiling.

The amount added of the anti-resoiling agent, relative to the total mass of the liquid detergent composition, is preferably from 0 to 2 mass %.

(Pearl Agents, Soil Release Agents)

Pearl agents and soil release agents and the like may also be added to the liquid detergent composition.

(Fragrances, Colorants, Emulsifiers and Extracts)

Fragrances, colorants, emulsifiers and extracts such as natural extracts may be added to the liquid detergent composition for purposes such as adding value to the product.

Representative examples of fragrances that may be used include the fragrance compositions A, B, C and D disclosed in Tables 11 to 18 of Japanese Unexamined Patent Application, First Publication No. 2002-146399.

The amount of the fragrance, relative to the total mass of the liquid detergent composition, is preferably from 0.1 to 1 mass %.

Examples of colorants include conventional dyes and pigments such as Acid Red 138, Polar Red RLS, Acid Yellow 203, Acid Blue 9, Blue No. 1, Blue No. 205, Green No. 3 and Turquoise P-GR (all product names).

The amount of the colorant, relative to the total mass of the liquid detergent composition, is preferably from approximately 0.00005 to 0.005 mass %.

Examples of emulsifiers include polystyrene emulsions and polyvinyl acetate emulsions, and emulsions having a solid fraction of 30 to 50 mass % can usually be used favorably. Specific examples include polystyrene emulsions (such as the emulsion manufactured by Saiden Chemical Industry Co., Ltd. under the brand name Saivinol RPX-196 PE-3, solid fraction: 40 mass %) and the like.

The amount of the emulsifier, relative to the total mass of the liquid detergent composition, is preferably from 0.01 to 0.5 mass %.

Examples of extracts that may be used include plant-based extracts from plants such as *Maackia amurensis*, bearberry leaf, *echinacea, Scutellaria baicalensis, Phellodendron amurense, Coptis japonica*, allspice, oregano, *Sophora japonica*, German chamomile, *Lonicera japonica, Sophora angustifolia, schizonepeta* spike, *Cinnamomum cassia*, laurel, *magnolia*, burdock, comfrey, *Torilis japonica*, burnet, peony, ginger, *Solidago altissima, Sambucus nigra*, sage, mistletoe, *Atractylodes lancea*, thyme, *Anemarrhena asphodeloides*, clove, Satsuma mandarin, tea tree, barberry, *Hottuynia, nandina*, frankincense, *Angelica dahurica*, Aglaophenia whiteleggei, Ledebouriella, *Psoralea corylifolia*, hops, rosewood, mountain grape, *Senna siamea, Melissa officinalis*, Belamcanda chinensis, Mosla *japonica*, eucalyptus, lavender, rose, rosemary, balun, Japanese cedar, *Abies balsamea, Dictamnus albus*, summer cypress, *Polygonum aviculare, Gentiana macrophylla, Liquidambar formosana, Adenophora triphylla, yamabishi, Cayratia japonica, Glycyrrhiza* and St. John's wort.

The amount added of this type of extract, relative to the total mass of the liquid detergent composition, is preferably from 0 to approximately 0.05 mass %.

[pH Modifier]

A pH modifier may be added to the liquid detergent composition of the present invention to adjust the pH to a desired value. However, in those cases where the desired pH is obtained with only the components described above, a pH modifier need not necessarily be added.

Any pH modifier can be used provided it does not impair the effects of the present invention, and examples include acidic compounds such as sulfuric acid and hydrochloric acid, alkanolamines such as monoethanolamine, diethanolamine and triethanolamine, and alkaline compounds such as sodium hydroxide and potassium hydroxide. A single pH modifier may be used alone, or a combination of two or more pH modifiers may be used as a mixture.

<Physical Properties of the Liquid Detergent Composition>

The liquid detergent composition of the present invention preferably has a pH at 25° C. within a range from 4 to 9, and a pH of 6 to 9 is particularly desirable. When the pH satisfies this type of range, the storage stability of the component (C) is superior, a powerful enzyme activity is maintained even after long-term storage, and superior anti-resoiling performance is obtained.

One aspect of the liquid detergent composition of the present invention is composed of: (A) a nonionic surfactant, (B) an anionic surfactant, (C) a protease, (D) at least one compound selected from the group consisting of thiazole-based compounds and sulfur-containing amino acids, and water, wherein relative to the total mass of the composition:

the amount of the component (A) is from 10 to 70 mass %, the amount of the component (13) is from 1 to 15 mass %, the amount of the component (C) is from 0.01 to 2 mass %, the amount of the component (D) is from 0.001 to 0.1 mass %, and the amount of water is from 20 to 80 mass %, provided that the combined mass of these components does not exceed 100 mass %.

Another aspect of the liquid detergent composition of the present invention is composed of: (A) a nonionic surfactant, (B) an anionic surfactant, (C) a protease, (D) at least one compound selected from the group consisting of thiazole-based compounds and sulfur-containing amino acids, (E) a calcium salt, and water, wherein relative to the total mass of the composition:

the amount of the component (A) is from 10 to 70 mass %, the amount of the component (13) is from 1 to 15 mass %, the amount of the component (C) is from 0.01 to 2 mass %, the amount of the component (D) is from 0.001 to 0.1 mass %, and the amount of water is from 20 to 80 mass %, provided that the combined mass of these components does not exceed 100 mass %, and the component (E) is added in an amount sufficient to generate a molar concentration of calcium ions of 0.1 to 15 mmol/L per 1 L of the liquid detergent composition.

Yet another aspect of the liquid detergent composition of the present invention is composed of: (A) a nonionic surfactant, (B) an anionic surfactant, (C) a protease, (D) at least one compound selected from the group consisting of thiazole-based compounds and sulfur-containing amino acids, (G) an α-hydroxy-monocarboxylic acid or a salt thereof, and water, wherein relative to the total mass of the composition:

the amount of the component (A) is from 10 to 70 mass %, the amount of the component (B) is from 1 to 15 mass %, the amount of the component (C) is from 0.01 to 2 mass %, the amount of the component (D) is from 0.001 to 0.1 mass %, the amount of the component (G) is from 0.1 to 5 mass %, and the amount of water is from 20 to 80 mass %, provided that the combined mass of these components does not exceed 100 mass %.

Yet another aspect of the liquid detergent composition of the present invention is composed of: (A) a nonionic surfactant, (B) an anionic surfactant, (C) a protease, (D) at least one compound selected from the group consisting of thiazole-based compounds and sulfur-containing amino acids, (E) a calcium salt, (G) an α-hydroxy-monocarboxylic acid or a salt thereof, and water, wherein relative to the total mass of the composition:

the amount of the component (A) is from 10 to 70 mass %, the amount of the component (B) is from 1 to 15 mass %, the amount of the component (C) is from 0.01 to 2 mass %, the amount of the component (D) is from 0.001 to 0.1 mass %, the amount of the component (G) is from 0.1 to 5 mass %, and the amount of water is from 20 to 80 mass %, provided that the combined mass of these components does not exceed 100 mass %, and the component (E) is added in an amount sufficient to generate a molar concentration of calcium ions of 0.1 to 15 mmol/L per 1 L of the liquid detergent composition.

Yet another aspect of the liquid detergent composition of the present invention is composed of: (A) a nonionic surfactant, (B) an anionic surfactant, (C) a protease, (D) at least one compound selected from the group consisting of thiazole-based compounds and sulfur-containing amino acids, (F) at least one enzyme selected from the group consisting of cellulases and lipases, wherein relative to the total mass of the composition:

the amount of the component (A) is from 10 to 70 mass %, the amount of the component (13) is from 1 to 15 mass %, the amount of the component (C) is from 0.01 to 2 mass %, the amount of the component (D) is from 0.001 to 0.1 mass %, the amount of the component (F) is from 0.01 to 2.0 mass %, and the amount of water is from 20 to 80 mass %, provided that the combined mass of these components does not exceed 100 mass %.

Yet another aspect of the liquid detergent composition of the present invention is composed of: (A) a nonionic surfactant, (B) an anionic surfactant, (C) a protease, (D) at least one compound selected from the group consisting of thiazole-based compounds and sulfur-containing amino acids, (E) a calcium salt, (F) at least one enzyme selected from the group consisting of cellulases and lipases, and water, wherein relative to the total mass of the composition:

the amount of the component (A) is from 10 to 70 mass %, the amount of the component (13) is from 1 to 15 mass %, the amount of the component (C) is from 0.01 to 2 mass %, the amount of the component (D) is from 0.001 to 0.1 mass %, the amount of the component (F) is from 0.01 to 2.0 mass %, and the amount of water is from 20 to 80 mass %, provided that the combined mass of these components does not exceed 100 mass %, and the component (E) is added in an amount sufficient to generate a molar concentration of calcium ions of 0.1 to 15 mmol/L per 1 L of the liquid detergent composition.

Yet another aspect of the liquid detergent composition of the present invention is composed of: (A) a nonionic surfactant, (B) an anionic surfactant, (C) a protease, (D) at least one compound selected from the group consisting of thiazole-based compounds and sulfur-containing amino acids, (F) at least one enzyme selected from the group consisting of cellulases and lipases, (G) an α-hydroxy-monocarboxylic acid or a salt thereof, and water, wherein relative to the total mass of the composition:

the amount of the component (A) is from 10 to 70 mass %, the amount of the component (B) is from 1 to 15 mass %, the amount of the component (C) is from 0.01 to 2 mass %, the amount of the component (D) is from 0.001 to 0.1 mass %, the amount of the component (F) is from 0.01 to 2.0 mass %, the amount of the component (G) is from 0.1 to 5 mass %, and the amount of water is from 20 to 80 mass %, provided that the combined mass of these components does not exceed 100 mass %.

Yet another aspect of the liquid detergent composition of the present invention is composed of: (A) a nonionic surfactant, (B) an anionic surfactant, (C) a protease, (D) at least one compound selected from the group consisting of thiazole-based compounds and sulfur-containing amino acids, (E) a calcium salt, (F) at least one enzyme selected from the group consisting of cellulases and lipases, (G) an α-hydroxy-monocarboxylic acid or a salt thereof, and water, wherein relative to the total mass of the composition:

the amount of the component (A) is from 10 to 70 mass %, the amount of the component (B) is from 1 to 15 mass %, the amount of the component (C) is from 0.01 to 2 mass %, the amount of the component (D) is from 0.001 to 0.1 mass %, the amount of the component (F) is from 0.01 to 2.0 mass %, the amount of the component (G) is from 0.1 to 5 mass %, and the amount of water is from 20 to 80 mass %, provided that the combined mass of these components does not exceed 100 mass %, and the component (E) is added in an amount sufficient to generate a molar concentration of calcium ions of 0.1 to 15 mmol/L per 1 L of the liquid detergent composition.

<Method of Producing Liquid Detergent Composition>

The liquid detergent composition containing the aforementioned components (A), (B), (C), (D), (E), (F) and (G), which represents one of the aspects described above, is preferably produced using a method in which the component (A), the component (B), the component (D), the component (E), the component (G), any optional components that are required, and water are first mixed together, and the component (C) and the component (F) are subsequently mixed into the mixture.

<Method of Using Liquid Detergent Composition>

The method of using the liquid detergent composition of the present invention (the laundering method) may be the same as the methods used for using typical liquid detergent compositions. Specific examples include a method in which the liquid detergent composition of the present invention (the present invention) is added to the water together with the items to be laundered at the time of laundering, a method in which the present invention is applied directly to dirt soiling or sebum soiling, and a method in which the present invention is first dissolved in water, and the items to be laundered are then immersed in the water. Further, a method in which the present invention is applied to the items to be laundered, and after standing for an appropriate length of time, normal laundering is performed using a typical washing liquid is also preferable.

The items to be laundered may be the same as items typically laundered using a typical detergent composition, and specific examples include textile items such as clothing, dishcloths, sheets and curtains.

The liquid detergent composition of the present invention, although being a composition containing the component (B), exhibits excellent storage stability of the component (C), and even following long-term storage, the activity of the component (C) is maintained at a satisfactory level. Accordingly, excellent anti-resoiling performance is obtained even after long-term storage.

EXAMPLES

The present invention is described below in further detail using a series of examples, but the present invention is in no way limited by these examples.

In the examples, unless stated otherwise, "%" refers to "mass %".

The measurement method and raw materials used in each of the following examples are described below.

[Measurement Method]

pH: The pH at 25° C. was measured using a pH meter (product name: HM-30G, manufactured by DKK To a Corporation).

[Raw Materials Used]

As the component (A), (a-1) to (a-3) described below were used.

(a-1): a nonionic surfactant produced by adding 15 molar equivalents of ethylene oxide to a natural alcohol CO-1270 manufactured by P&G Company (carbon number: 12 to 14, linear structure). A synthetic product synthesized using the procedure described below.

(a-2): a mixture of $C_{11}H_{23}CO(OCH_2CH_2)_{15}OCH_3$ and $C_{13}H_{27}CO(OCH_2CH_2)_{15}OCH_3$ in a mass ratio of 8/2 (narrow ratio: 33 mass %). A synthetic product synthesized using the procedure described below.

(a-3): $(C_nH_{2n+1})CH(C_mH_{2m+1})O(EO)_9H$ (m+n=11 to 13, a polyoxyethylene alkyl ether having a branched alkyl group with a carbon number of 12 to 14). An EO (ethylene oxide) adduct of a branched chain-containing secondary alcohol containing an average of 9 moles of EO, manufactured by Nippon Shokubai Co., Ltd.

Synthesis of (a-1):

A pressure-resistant reaction vessel was charged with 224.4 g of a natural alcohol CO-1270 manufactured by P&G Company and 2.0 g of a 30% aqueous solution of NaOH, and the inside of the vessel was flushed with nitrogen. The solution was dewatered for 30 minutes at a temperature of 100° C. under a pressure of 2.0 kPa, and the temperature was then raised to 160° C. Subsequently, with the alcohol inside the vessel undergoing constant stirring, 760.4 g of (gaseous) ethylene oxide was added gradually to the alcohol through a bubbling tube, with the rate of addition controlled so that the reaction temperature did not exceed 180° C.

Following completion of the addition of ethylene oxide, the mixture was heated for 30 minutes at a temperature of 180° C. under a pressure of not more than 0.3 MPa, and any unreacted ethylene was then removed by distillation for 10 minutes at a temperature of 180° C. under a pressure of not more than 6.0 kPa. Subsequently, the temperature was cooled to 100° C. or lower, and neutralization was performed by adding sufficient 70% p-toluenesulfonic acid to adjust the pH of a 1% aqueous solution of the reaction product to pH 7, thus yielding the surfactant (a-1).

Synthesis of (a-2):

Production was performed in accordance with a production example 1 described in the examples disclosed within Japanese Unexamined Patent Application, First Publication No. 2000-144179. In other words, an alumina-magnesium hydroxide having a chemical composition of $2.5MgO.Al_2O_3.nH_2O$ (product name: Kyoward 300, manufactured by Kyowa Chemical Industry Co., Ltd.) was first calcined under a nitrogen atmosphere at 600° C. for one hour. Subsequently, a 4 liter autoclave was charged with 2.2 g of the thus obtained calcined alumina-magnesium hydroxide (unmodified) catalyst, 2.9 mL of a 0.5 N ethanol solution of potassium hydroxide, 280 g of methyl laurate and 70 g of methyl myristate, and the catalyst was modified inside the autoclave. Subsequently, the inside of the autoclave was flushed with nitrogen, the temperature was increased, and with the temperature held at 180° C. and the pressure held at 3 atm, 1,052 g of ethylene oxide was introduced into the autoclave and reacted under constant stirring. The reaction liquid was then cooled to 80° C., 159 g of water was added, together with 5 g of each of activated clay and diatomaceous earth as filtration assistants, and the catalyst was then filtered off, yielding the surfactant (a-2). By controlling the amount of alkali added relative to the catalyst, the narrow ratio was adjusted to 33 mass %.

As the component (B), (b-1) to (b-3) described below were used.

(b-1): LAS, a linear alkyl (carbon number: 10 to 14) benzenesulfonic acid [manufactured by Lion Corporation, product name: Lipon LH-200 (LAS-H), pure fraction: 96 mass %], average molecular weight: 322.

(b-2): AES, a sodium polyoxyethylene alkyl ether sulfate having a carbon number of C12 to C13 (average number of added moles of ethylene oxide: 2). A synthetic product synthesized using the procedure described below.

(b-3): SAS: sodium secondary-alkane sulfonate, manufactured by Clariant Japan K.K., product name: SAS30.

Synthesis of (b-2):

A 4 liter autoclave was charged with 400 g of Neodol 23 [a product name, manufactured by Shell Chemicals Ltd., a C12, C13 alcohol (a mixture in which the mass ratio of alcohols having a carbon number of 12 and alcohols having a carbon number of 13 is 1/1), branched fraction: 20 mass %] as a raw material alcohol and 0.8 g of a potassium hydroxide catalyst, the inside of the autoclave was flushed with nitrogen, and the temperature was increased with constant stirring. With the temperature held at 180° C. and the pressure held at 0.3 mPa, 272 g of ethylene oxide was then introduced into the reaction solution, yielding a reaction product (alcohol ethoxylate) having an average of 2 added moles of ethylene oxide.

Subsequently, 280 g of the thus obtained alcohol ethoxylate was placed in a 500 mL flask fitted with a stirrer, and following flushing of the flask with nitrogen, 67 g of liquid sulfuric anhydride (sulfan) was added dropwise in a gradual manner so that the reaction temperature was maintained at 40° C. Following completion of the dropwise addition, stirring was continued for one hour (sulfation reaction), yielding a polyoxyethylene alkyl ether sulfate. By subsequently neutralizing this polyoxyethylene alkyl ether sulfate with an aqueous solution of sodium hydroxide, the surfactant (b-2) was obtained.

As the component (C), (c-1) and (c-2) described below were used.

(c-1): a protease preparation (manufactured by Novozymes A/S, product name: Coronase 48L).

(c-2): a protease preparation (manufactured by Novozymes A/S, product name: Everlase 16L Type EX).

As the component (D), (d-1) to (d-5) described below were used.

(d-1): 1,2-benzoisothiazolin-3-one (manufactured by Arch Chemicals, Inc., product name: Proxel XL).

(d-2): 2-methyl-4-isothiazolin-3-one.

(d-3): 5-chloro-2-methyl-4-isothiazolin-3-one.

(d-4): L-cysteine (manufactured by Kanto Chemical Co., Inc.).

(d-5): 3-((4-amino-2-methylpyrimidin-5-yl)methyl)-5-(2-hydroxyethyl)-4-methylthiazol-3-ium chloride (manufactured by Kanto Chemical Co., Inc., product name: thiamine chloride).

As component (D) comparative components, (d'-6) and (d'-7) described below were used.

(d'-6): benzalkonium chloride (manufactured by Lion Akzo Co., Ltd., product name: Arquad CB).

(d'-7): L-alanine (manufactured by Kanto Chemical Co., Inc.).

As the component (E), (e-1) described below was used.

(e-1): calcium chloride (the dihydrate was used, manufactured by Kanto Chemical Co., Inc., reagent grade)

As the component (F), (f-1) and (f-2) described below were used.

(f-1): a cellulase preparation (manufactured by Novozymes A/S, product name: Endolase 5000L).

(f-2): a lipase preparation (manufactured by Novozymes A/S, product name: Lipex 100L).

As the component (G), (g-1) described below was used.

(g-1): sodium lactate (manufactured by Kanto Chemical Co., Inc.).

Other components used included the components listed below.

Propylene glycol: manufactured by Asahi Glass Co., Ltd.

Ethanol: manufactured by Japan Alcohol Trading Co., Ltd., product name: special alcohol 95%.

Citric acid: anhydrous citric acid, manufactured by Iwata Chemical Co., Ltd.

Monoethanolamine: manufactured by Kanto Chemical Co., Inc.

Further, the following reagents were used as pH modifiers.

Sodium hydroxide: manufactured by Kanto Chemical Co., Inc.

Hydrochloric acid: manufactured by Kanto Chemical Co., Inc.

Examples 1 to 22, Comparative Examples 1 to 9

Using the procedure described below, liquid detergent compositions were produced with the formulations shown in Tables 1 and 2 (units: mass %).

A 500 mL beaker was charged with 5.0 mass % of propylene glycol, 5.0 mass % of 95% ethanol, 0.1 mass % of citric acid, 1.0 mass % of monoethanolamine, and the type and amount of the component (A) shown in Table 1 or 2, and these components were mixed and dissolved. Subsequently, the types and amounts of the component (B), the component (E) and the component (G) shown in Table 1 or 2 were added and stirred, and distilled water was then added in an amount sufficient to make the mass of the composition up to 90 mass % of the total mass of the final liquid detergent composition. Subsequently, sodium hydroxide and hydrochloric acid were used as pH modifiers to adjust the pH of the liquid detergent composition at 25° C. to a value of 8.5. The types and amounts of the component (C), the component (D) and the component (F) shown in Table 1 or 2 were then added, and distilled water was then added to increase the total mass of the final product to 100 mass %, thus yielding a liquid detergent composition.

The liquid detergent compositions obtained in Examples 1 to 22 and Comparative Examples 1 to 9 were evaluated in the manner described below. The results of the evaluations are also shown in Tables 1 and 2.

<Measurement and Evaluation of Enzyme Activity>

(Measurement of Protease Activity)

A milk casein (Casein, bovine milk, carbohydrate and fatty acid free/Calbiochem (a registered trademark)) was dissolved in 1 N sodium hydroxide (1 mol/L sodium hydroxide solution (1 N), manufactured by Kanto Chemical Co., Inc.), the pH was adjusted to 10.5, and the solution was diluted with a 0.05 M aqueous solution of boric acid (boric acid (guaranteed reagent grade), manufactured by Kanto Chemical Co., Inc.) to achieve a milk casein concentration of 0.6%, thus forming a protease substrate.

Subsequently, 1 g of the obtained liquid detergent composition was diluted 25-fold with a 3° DH hard water containing calcium chloride (calcium chloride (guaranteed reagent grade), manufactured by Kanto Chemical Co., Inc.) to prepare a sample solution.

To 1 g of the sample solution was added 5 g of the aforementioned protease substrate, and following stirring for 10 seconds using a vortex mixer, the mixture was left to stand for 30 minutes at 37° C. to allow the enzyme reaction to proceed. Subsequently, 5 g of a 0.44 M aqueous solution of an enzyme reaction inhibitor TCA (trichloroacetic acid (guaranteed reagent grade), manufactured by Kanto Chemical Co., Inc.) was added to the solution and stirred for 10 seconds using a vortex mixer. Subsequently, the solution was left to stand for 30 minutes at 20° C., the precipitated unreacted substrate was removed using a 0.45 μm filter, and the filtrate was collected.

The absorbance of the collected filtrate at a wavelength of 275 nm (absorbance A) was measured using a UV-VIS spectrophotometer UV-160 manufactured by Shimadzu Corporation. A larger value for the absorbance A indicated that a larger amount of tyrosine (produced by decomposition of the protease substrate by protease) existed within the filtrate.

In order to remove the effects of absorption by materials other than the target component, 5 g of the enzyme reaction inhibitor TCA was added to a separate 1 g sample of the sample solution, and following stirring for 10 seconds using a vortex mixer, 5 g of the protease substrate was added, stirring was performed for another 10 seconds using the vortex mixer, the mixture was filtered using a 0.45 μm filter, and the filtrate was collected. The absorbance of the filtrate at a wavelength of 275 nm (absorbance B) was then measured using the UV-160.

(Evaluation of Storage Stability of Protease Activity)

Following production, a sample of the liquid detergent composition that had been stored for 4 weeks at 35° C. (35° C. stored product) and a sample of the liquid detergent composition that had been stored for 4 weeks at 4° C. (4° C. stored product) were each subjected to measurement of the protease activity in the manner described above, and based on the measurement results, the residual protease activity (%) was calculated in the manner described below.

In order to exclude the effect of scattered light from air bubbles and the like, the value of the absorbance at 275 nm for each sample in the following formula used a value obtained by subtracting the absorbance at 600 nm, which was measured at the same time.

Residual protease activity=(absorbance A of 35° C. stored product−absorbance B of 35° C. stored product)/(absorbance A of 4° C. stored product−absorbance B of 4° C. stored product)×100

Based on the thus determined residual protease activity (%), the storage stability of the protease activity was evaluated against the following evaluation criteria. The results are shown in Tables 1 and 2.

◎: at least 80%

○: at least 65% but less than 80%

Δ: at least 50% but less than 65%

X: less than 50%

(Measurement of Cellulase Activity)

To 20 g of a cellulose powder Avicel (manufactured by Fluka AG, No. 11365) was added 600 ml of an 85 mass % solution of phosphoric acid, and with the mixture cooled in an ice bath and undergoing gentle stirring, 400 ml of acetone was added to effect swelling. The resulting solution was filtered using a filter, and was then washed 3 times with 400 ml samples of acetone, and 7 times with 1,000 ml samples of Milli-Q water. Finally, 2,000 ml of Milli-Q water was added to complete preparation of a cellulase substrate.

A centrifuge tube was charged with 2 mL of the sample solution (the liquid detergent composition), 2 mL of a 0.1 M phosphate buffer, and 2 mL of the aforementioned cellulase substrate, and with the mixture undergoing constant stirring, the tube was placed in a water bath at 50° C. for 60 minutes to allow the reaction to proceed. Subsequently, 1 mL of a 2% aqueous solution of NaOH was added to halt the reaction. The centrifuge tube was placed in a centrifuge (4,000 rpm, 10 minutes), the supernatant was collected, and to 4 mL of this supernatant was added and stirred 2 mL of a coloring reagent PAHBAH solution (prepared by adding 5.0 g of (+)-potassium sodium tartarate tetrahydrate and 0.193 g of Bismuth (III) acetate to 1.5 g of PAHBAH (4-hydroxybenzhydrazide, manufactured by Sigma-Aldrich Co. LLC., No. H-9882), and then making the solution up to 100 ml with a 2% aqueous solution of NaOH). Subsequently, the resulting solution was boiled at 100° C. for 8 minutes to react the glucose reducing sugar and the coloring reagent. The solution was then cooled in an ice bath, and the absorbance at a wavelength of 410 nm was measured.

In a separate preparation, standard enzyme solutions were prepared and a calibration curved was produced using the procedure described below.

In other words, 0.175 g of a standard enzyme (5,700 ECU/g) was dissolved in 1 L of a 0.1 M phosphate buffer to prepare a mother liquor. This mother liquor was diluted in a stepwise manner using the 0.1 M phosphate buffer to prepare 5 stages of standard solutions composed of only the 0.1 M phosphate buffer, a 250-fold diluted solution of the mother liquor, a 50-fold diluted solution of the mother liquor, a 25-fold diluted solution of the mother liquor, and a 12.5-fold diluted solution of the mother liquor respectively, and these standard solutions were then treated in the same manner as the sample solution. Subsequently, the absorbance of each standard solution at a wavelength of 410 nm was measured, and a calibration curve was produced.

Based on the thus produced calibration curve, the potency of each sample solution (liquid detergent composition) was determined.

(Evaluation of Storage Stability of Cellulase Activity)

Following production, a sample of the liquid detergent composition that had been stored for 4 weeks at 35° C. (35° C. stored product) and a sample of the liquid detergent composition that had been stored for 4 weeks at 4° C. (4° C. stored product) were each subjected to measurement of the cellulase activity in the manner described above, and the potency of each liquid detergent composition was determine from the calibration curve produced using the standard enzyme. Based on these results, the residual cellulase activity (%) was calculated in the manner described below.

Residual cellulase activity=potency of 35° C. stored product/potency of 4° C. stored product×100

Based on the thus determined residual cellulase activity (%), the storage stability of the cellulase activity was evaluated against the following evaluation criteria. The results are shown in Tables 1 and 2.

◎: at least 80%

○: at least 65% but less than 80%

Δ: at least 50% but less than 65%

X: less than 50%

(Measurement of Lipase Activity)

Using olive oil as a substrate, the amount of fatty acid freed by lipase activity was measured by alkali titration using the procedure described below, and the resulting value was used to determine the lipase activity. In terms of enzyme units, the amount of enzyme that frees 1 μM of fatty acid in one minute from the substrate olive oil at 37° C. was deemed to be 1 unit.

Specifically, 4 ml of an olive oil emulsion and 4 ml of a 0.1 M phosphate buffer (pH 7.0) were measured accurately into a 50 ml stoppered Erlenmeyer flask, and following thorough mixing, the mixture was heated for 10 minutes in a 37° C. constant-temperature water bath. Subsequently, 1 ml of the sample solution (liquid detergent composition) was added accurately to the flask and mixed. Exactly 20 minutes after addition of the sample solution, 20 ml of a mixed acetone-ethanol solution (acetone/ethanol=1/1 (mass ratio)) was added. Subsequently, using 5 drops of phenolphthalein as an indicator, a titration was performed using a 0.05 N sodium hydroxide reagent, and the resulting titer was recorded as the sample solution titer.

In a separate preparation, 5 ml of the olive oil emulsion and 4 ml of the 0.1 M phosphate buffer (pH 7.0) were measured accurately into a 50 ml stoppered Erlenmeyer flask, and the mixture was heated for 10 minutes in a 37° C. constant-temperature water bath. Subsequently, 20 ml of the aforementioned mixed acetone-ethanol solution was added, and 1 ml of the sample solution was then added accurately to the flask. Subsequently, using 5 drops of phenolphthalein as an indicator, a titration was performed using a 0.05 N sodium hydroxide reagent, and the resulting titer was recorded as the comparative titer.

In the titration with 0.05 N sodium hydroxide, the point where the sample solution turned red was taken as the end point.

Based on the results, the lipase potency (units/g) was determined using the numerical formula shown below.

Lipase potency (units/g)=(sample solution titer−comparative titer)/lipase preparation (g) per 1 mg of the sample solution×2.5

(Evaluation of Storage Stability of Lipase Activity)

A sample of the liquid detergent composition immediately following production (before storage) and sample of the liquid detergent composition that had been stored for 4 weeks at 35° C. (after storage) were each subjected to measurement of the lipase activity in the manner described above, and based on the results of these measurements, the residual lipase activity (%) was calculated using the formula shown below.

Residual lipase activity=lipase potency after storage/lipase potency before storage×100

Based on the thus determined residual lipase activity (%), the storage stability of the lipase activity was evaluated against the following evaluation criteria. The results are shown in Tables 1 and 2.

◎: at least 80%

○: at least 65% but less than 80%

Δ: at least 50% but less than 65%

X: less than 50%

<Evaluation of Anti-Resoiling Performance Before and After Storage>

The anti-resoiling performance of the liquid detergent composition was evaluated before and after storage for 4 weeks at 35° C. using the procedure described below.

A laundry treatment was performed by repeating the following steps of laundering, rinsing and drying three times.

[Laundering]

Using a Terg-O-Tometer (manufactured by United States Testing Company), 0.6 g of the liquid detergent composition was added to 900 mL of a 3° DH hard water at 25° C., and into the resulting solution were placed a series of cloth pieces (five 5 cm×5 cm cloths of knitted cotton (manufactured by Tanigashira Shoten K.K.) as resoiling test cloths for cotton fabric, five 5 cm×5 cm cloths of polyester tropical (manufactured by Tanigashira Shoten K.K.) as resoiling test cloths for polyester (PE), as well as 20 pieces of wet artificially soiled cloths (manufactured by Sentaku Kagaku Kyoukai (Foundation for Laundry Science), the soiling component is composed of oleic acid 28.3%, triolein 15.6%, cholesterol oleate 12.2%, liquid paraffin 2.5%, squalene 2.5%, cholesterol 1.6%, gelatin 7.0%, mud 29.8%, and carbon black 0.5%), and an undershirt (LL size, manufactured by DVD, Inc.) that had been cut into small pieces (of approximately 3 cm×3 cm)), the bath ratio was then adjusted to 20-fold using 3° DH hard water, and the cloth pieces were laundered for 10 minutes at 25° C. at 120 rpm.

[Rinsing]

The laundered cloth pieces were spun dry for one minute, and then rinsed for 3 minutes at 120 rpm in 900 mL of a 3° DH hard water at 25° C. This rinse process was repeated twice. On the second repetition, a predetermined amount of a fabric softener was added. Heyaboshi Soflan (manufactured by Lion Corporation) was used as the fabric softener.

[Drying]

The rinsed cloth pieces were spun dry for one minute, and only the resoiling test cloths were removed. These resoiling test cloths were sandwiched between filter paper and dried using an iron.

The reflectance of the resoiling test cloths before and after the laundry treatment was measured by using a reflectance meter (Spectroscopic Color-Difference Meter SE 2000, manufactured by Nippon Denshoku Industries Co., Ltd.) to measure the Z value (reflectivity), and the value of ΔZ was determined by subtracting the Z value after the laundry treatment from the Z value before the laundry treatment. For the resoiling test cloths for cotton fabric and the resoiling test cloths for PE, the average value across the 5 cloth pieces was determined. Further, based on the thus obtained average values, the anti-resoiling performance for the cotton test cloths and the PE test cloths were evaluated against the criteria shown below. The results are shown in Tables 1 and 2.

(Anti-Resoiling Performance: For Cotton Cloth)

◎: ΔZ less than 5

○: ΔZ at least 5, but less than 7

Δ: ΔZ at least 7, but less than 9

X: ΔZ 9 or greater (Anti-Resoiling Performance: For PE Cloth)

◎: ΔZ less than 3

○: ΔZ at least 3, but less than 4

Δ: ΔZ at least 4, but less than 5

X: ΔZ 5 or greater

TABLE 1

| | | | Example | | | | | | | | | | | | | | |
|---|---|---|---|---|---|---|---|---|---|---|---|---|---|---|---|---|---|
| | | | 1 | 2 | 3 | 4 | 5 | 6 | 7 | 8 | 9 | 10 | 11 | 12 | 13 | 14 | 15 |
| Composition | A | a-1 | 25 | 10 | 15 | | | 25 | 25 | 25 | 25 | 25 | 25 | 25 | 25 | 25 | 25 |
| | | a-2 | | | 40 | 55 | | | | | | | | | | | |
| | | a-3 | | | | | 55 | | | | | | | | | | |
| | B | b-1 | 5 | 5 | 5 | 5 | 5 | | | 1 | 10 | 5 | 5 | 5 | 5 | 5 | 5 |
| | | b-2 | | | | | | 5 | | | | | | | | | |
| | | b-3 | | | | | | | 5 | | | | | | | | |
| | C | c-1 | 0.4 | 0.4 | 0.4 | 0.4 | 0.4 | 0.4 | 0.4 | 0.4 | 0.4 | 0.1 | 0.2 | | 0.4 | 0.4 | 0.4 |
| | | c-2 | | | | | | | | | | | | 0.4 | | | |
| | F | f-1 | | | | | | | | | | | | | 0.4 | | |
| | | f-2 | | | | | | | | | | | | | | 0.4 | |
| | D | d-1 | 0.02 | 0.02 | 0.02 | 0.02 | 0.02 | 0.02 | 0.02 | 0.02 | 0.02 | 0.02 | 0.02 | 0.02 | 0.02 | 0.02 | 0.001 |
| | water | | 58 | 73 | 28 | 28 | 28 | 58 | 58 | 62 | 53 | 59 | 59 | 58 | 58 | 58 | 58 |

TABLE 1-continued

| | | | Example | | | | | | | | | | | | | | |
|---|---|---|---|---|---|---|---|---|---|---|---|---|---|---|---|---|---|
| | | | 1 | 2 | 3 | 4 | 5 | 6 | 7 | 8 | 9 | 10 | 11 | 12 | 13 | 14 | 15 |
| optional com-ponents | | propylene glycol | 5 | 5 | 5 | 5 | 5 | 5 | 5 | 5 | 5 | 5 | 5 | 5 | 5 | 5 | 5 |
| | | ethanol | 5 | 5 | 5 | 5 | 5 | 5 | 5 | 5 | 5 | 5 | 5 | 5 | 5 | 5 | 5 |
| | | citric acid | 0.1 | 0.1 | 0.1 | 0.1 | 0.1 | 0.1 | 0.1 | 0.1 | 0.1 | 0.1 | 0.1 | 0.1 | 0.1 | 0.1 | 0.1 |
| | | mono-ethanolamine | 1 | 1 | 1 | 1 | 1 | 1 | 1 | 1 | 1 | 1 | 1 | 1 | 1 | 1 | 1 |
| PH | | | 8.5 | 8.5 | 8.5 | 8.5 | 8.5 | 8.5 | 8.5 | 8.5 | 8.5 | 8.5 | 8.5 | 8.5 | 8.5 | 8.5 | 8.5 |
| A + B | | | 30.0 | 15.0 | 60.0 | 60.0 | 60.0 | 30.0 | 30.0 | 26.0 | 35.0 | 30.0 | 30.0 | 30.0 | 30.0 | 30.0 | 30.0 |
| B/A | | | 0.2 | 0.5 | 0.3 | 0.09 | 0.09 | 0.2 | 0.2 | 0.0 | 0.4 | 0.2 | 0.2 | 0.2 | 0.2 | 0.2 | 0.2 |
| D/C | | | 0.050 | 0.050 | 0.050 | 0.050 | 0.050 | 0.050 | 0.050 | 0.050 | 0.050 | 0.200 | 0.100 | 0.050 | 0.025 | 0.025 | 0.003 |
| Protease activity | | residual activity | 80 | 75 | 65 | 65 | 65 | 80 | 80 | 85 | 65 | 80 | 80 | 85 | 80 | 80 | 70 |
| | | storage stability | ◎ | ○ | ○ | ○ | ○ | ◎ | ◎ | ◎ | ○ | ◎ | ◎ | ◎ | ◎ | ◎ | ○ |
| Cellulase activity | | residual activity | — | — | — | — | — | — | — | — | — | — | — | — | 80 | — | — |
| | | storage stability | — | — | — | — | — | — | — | — | — | — | — | — | ◎ | — | — |
| Lipase activity | | residual activity | — | — | — | — | — | — | — | — | — | — | — | — | — | 80 | — |
| | | storage stability | — | — | — | — | — | — | — | — | — | — | — | — | — | ◎ | — |
| Cotton cloth | before storage | ΔZ | 4 | 5.5 | 3.5 | 3.5 | 3.5 | 4.5 | 4.5 | 6 | 3 | 5.5 | 5 | 4.5 | 3 | 4 | 4 |
| | | anti-resoiling performance | ◎ | ○ | ◎ | ◎ | ◎ | ◎ | ◎ | ○ | ◎ | ○ | ○ | ◎ | ◎ | ◎ | ◎ |
| | after storage | ΔZ | 4 | 6 | 4.5 | 4.5 | 4.5 | 4.5 | 4.5 | 6 | 4 | 5.5 | 5 | 4.5 | 3 | 4 | 5 |
| | | anti-resoiling performance | ◎ | ○ | ◎ | ◎ | ◎ | ◎ | ◎ | ○ | ◎ | ○ | ○ | ◎ | ◎ | ◎ | ○ |
| PE cloth | before storage | ΔZ | 2 | 2 | 2 | 2 | 2 | 2 | 2 | 3 | 2 | 3 | 3 | 2 | 2 | 1.5 | 2 |
| | | anti-resoiling performance | ◎ | ◎ | ◎ | ◎ | ◎ | ◎ | ◎ | ○ | ◎ | ○ | ○ | ◎ | ◎ | ◎ | ◎ |
| | after storage | ΔZ | 2 | 3 | 3.5 | 3.5 | 3.5 | 2 | 2 | 3 | 3 | 3 | 3 | 2 | 2 | 1.5 | 3 |
| | | anti-resoiling performance | ◎ | ○ | ○ | ○ | ○ | ◎ | ◎ | ○ | ○ | ○ | ○ | ◎ | ◎ | ◎ | ○ |

TABLE 2

| | | | Example | | | | | | | Comparative example | | | | | | | | |
|---|---|---|---|---|---|---|---|---|---|---|---|---|---|---|---|---|---|---|
| | | | 16 | 17 | 18 | 19 | 20 | 21 | 22 | 1 | 2 | 3 | 4 | 5 | 6 | 7 | 8 | 9 |
| Com-po-sition | A | a-1 | 25 | 25 | 25 | 25 | 25 | 25 | 25 | 25 | 25 | 25 | 25 | 5 | 75 | 25 | 25 | 25 |
| | B | b-1 | 5 | 5 | 5 | 5 | 5 | 5 | 5 | 5 | 5 | 0 | 20 | 5 | 5 | 5 | 5 | 5 |
| | C | c-1 | 1 | 0.4 | 0.4 | 0.4 | 0.4 | 0.4 | 0.4 | 0.4 | 0.4 | 0.4 | 0.4 | 0.4 | 0.4 | 0.4 | 0.4 | 0.4 |
| | D | d-1 | 0.001 | | | | | 0.02 | 0.02 | | | 0.02 | 0.02 | 0.02 | 0.02 | | | |
| | | d-2 | | 0.02 | | | | | | | | | | | | | | |
| | | d-3 | | | 0.02 | | | | | | 0.0005 | | | | | | | |
| | | d-4 | | | | 0.02 | | | | | | | | | | | | 0.5 |
| | | d-5 | | | | | 0.02 | | | | | | | | | | | |
| | | d'-6 | | | | | | | | | | | | | | 0.02 | | |
| | | d'-7 | | | | | | | | | | | | | | | 0.02 | |
| | E | c-1 | | | | | | 0.1 | 0.1 | | | | | | | | | |
| | G | g-1 | | | | | | | 0.5 | | | | | | | | | |
| water | | | 58 | 58 | 58 | 58 | 58 | 58 | 58 | 59 | 58 | 63 | 43 | 78 | 8 | 58 | 59 | 59 |
| optional com-ponents | | propylene glycol | 5 | 5 | 5 | 5 | 5 | 5 | 5 | 5 | 5 | 5 | 5 | 5 | 5 | 5 | 5 | 5 |
| | | ethanol | 5 | 5 | 5 | 5 | 5 | 5 | 5 | 5 | 5 | 5 | 5 | 5 | 5 | 5 | 5 | 5 |
| | | citric acid | 0.1 | 0.1 | 0.1 | 0.1 | 0.1 | 0.1 | 0.1 | 0.1 | 0.1 | 0.1 | 0.1 | 0.1 | 0.1 | 0.1 | 0.1 | 0.1 |
| | | mono-ethanol-amine | 1 | 1 | 1 | 1 | 1 | 1 | 1 | 1 | 1 | 1 | 1 | 1 | 1 | 1 | 1 | 1 |
| pH | | | 8.5 | 8.5 | 8.5 | 8.5 | 8.5 | 8.5 | 8.5 | 8.5 | 8.5 | 8.5 | 8.5 | 8.5 | 8.5 | 8.5 | 8.5 | 8.5 |
| A + B | | | 30.0 | 30.0 | 30.0 | 30.0 | 30.0 | 30.0 | 30.0 | 30.0 | 30.0 | 25.0 | 45.0 | 10.0 | 80.0 | 30.0 | 30.0 | 30.0 |
| B/A | | | 0.2 | 0.2 | 0.2 | 0.2 | 0.2 | 0.2 | 0.2 | 0.2 | 0.2 | 0.0 | 0.8 | 1.0 | 0.1 | 0.2 | 0.2 | 0.2 |
| D/C | | | 0.001 | 0.050 | 0.050 | 0.050 | 0.050 | 0.050 | 0.001 | — | 0.00125 | 0.050 | 0.050 | 0.050 | 0.050 | 0.050 | 0.050 | 1.200 |
| Protease activity | | residual activity | 65 | 75 | 75 | 75 | 80 | 85 | 88 | 45 | 50 | 85 | 45 | 70 | 45 | 45 | 45 | 40 |
| | | storage stability | ○ | ○ | ○ | ○ | ◎ | ◎ | ◎ | X | Δ | ◎ | X | ○ | X | X | X | X |
| Cellulase activity | | residual activity | — | — | — | — | — | — | — | — | — | — | — | — | — | — | — | — |
| | | storage stability | — | — | — | — | — | — | — | — | — | — | — | — | — | — | — | — |
| Lipase activity | | residual activity | — | — | — | — | — | — | — | — | — | — | — | — | — | — | — | — |
| | | storage stability | — | — | — | — | — | — | — | — | — | — | — | — | — | — | — | — |

TABLE 2-continued

| | | | Example | | | | | | | Comparative example | | | | | | | | |
|---|---|---|---|---|---|---|---|---|---|---|---|---|---|---|---|---|---|---|
| | | | 16 | 17 | 18 | 19 | 20 | 21 | 22 | 1 | 2 | 3 | 4 | 5 | 6 | 7 | 8 | 9 |
| Cotton cloth | before storage | ΔZ | 4 | 4 | 4 | 4 | 4 | 4 | 4 | 4 | 4 | 12 | 3 | 6 | 3.5 | 4 | 4 | 4 |
| | | anti-resoiling performance | ◎ | ◎ | ◎ | ◎ | ◎ | ◎ | ◎ | ◎ | ◎ | X | ◎ | ○ | ◎ | ◎ | ◎ | ◎ |
| | after storage | ΔZ | 4 | 4.5 | 4.5 | 4.5 | 4 | 4 | 4 | 6 | 6 | 12 | 5 | 7 | 5.5 | 6 | 6 | 6 |
| | | anti-resoiling performance | ◎ | ◎ | ◎ | ◎ | ◎ | ◎ | ◎ | ○ | ○ | X | ○ | Δ | ○ | ○ | ○ | ○ |
| PE cloth | before storage | ΔZ | 2 | 2 | 2 | 2 | 2 | 2 | 2 | 2 | 2 | 5 | 2 | 3 | 2 | 2 | 2 | 2 |
| | | anti-resoiling performance | ◎ | ◎ | ◎ | ◎ | ◎ | ◎ | ◎ | ◎ | ◎ | X | ◎ | ○ | ◎ | ◎ | ◎ | ◎ |
| | after storage | ΔZ | 2 | 2.5 | 2.5 | 2.5 | 2 | 2 | 2 | 4 | 3.5 | 5 | 3 | 4.5 | 4 | 4 | 4 | 4 |
| | | anti-resoiling performance | ◎ | ◎ | ◎ | ◎ | ◎ | ◎ | ◎ | Δ | ○ | X | ○ | Δ | Δ | Δ | Δ | Δ |

As illustrated in Tables 1 and 2, the liquid detergent compositions of Examples 1 to 22 all exhibited excellent storage stability of the protease activity. Further, both the anti-resoiling performance for cotton cloth and the anti-resoiling performance for PE cloth were excellent before storage and after storage. Furthermore, in Example 13 which also contained a cellulase, the cellulase storage stability was good, and the anti-resoiling performance for cotton cloth was superior to even that of Example 1, which had the same composition other than the absence of the cellulase. Moreover, in Example 14 which also contained a lipase, the lipase storage stability was good, and the anti-resoiling performance for PE cloth was superior to even that of Example 1, which had the same composition other than the absence of the lipase.

On the other hand, Comparative Example 1 which did not contain the component (D) and Comparative Example 2 in which the amount of the component (D) was only 0.0005% exhibited poor storage stability of the protease activity, and the anti-resoiling performance after storage was inferior to that observed before storage. Comparative Example 3 which did not contain the component (B) exhibited excellent storage stability of the protease activity, but the anti-resoiling performance was poor both before and after storage. Comparative Example 4 which contained 20% of the component (B) exhibited poor storage stability of the protease activity, and the anti-resoiling performance after storage was inferior to that observed before storage. Comparative Example 5 in which the amount of the component (A) was only 5% exhibited comparatively good storage stability of the protease activity, but the anti-resoiling performance after storage was poor. Comparative Example 6 which contained 75% of the component (A) exhibited poor storage stability of the protease activity, and the anti-resoiling performance after storage was inferior. Comparative Examples 7 and 8, which contained benzalkonium chloride or L-alanine respectively instead of the component (D), and Comparative Example 9 in which the amount of the component (D) was 0.5% exhibited poor storage stability of the protease activity, and the anti-resoiling performance after storage was inferior.

INDUSTRIAL APPLICABILITY

The present invention is able to provide a liquid detergent composition which, even following long-term storage, exhibits a high level of protease activity and excellent anti-resoiling performance, and is therefore extremely useful industrially.

We claim:

1. A liquid detergent composition comprising: (A) 10 to 70 mass % of a nonionic surfactant represented by general formula (I): $R^1$—X—$[(EO)_s/(PO)_t]$—$R^2$ (I), wherein $R^1$ represents a hydrophobic group of 8 to 22 carbon atoms; X represents —O—, —CONH— or —COO—; EO represents an ethylene oxide group; s represents the average number of added moles of EO, and is at least 9; PO represents a propylene oxide group; t represents the average number of added moles of PO, and is from 0 to 6; the EO and PO may be arranged randomly or in a block arrangement; $R^2$ represents a hydrogen atom, an alkyl group of 1 to 6 carbon atoms or an alkenyl group of 1 to 6 carbon atoms when X is —O— or —CONH—, and represents and alkyl group of 1 to 6 carbon atoms or an alkenyl group of 1 to 6 carbon atoms when X is —COO—, (B) 1 to 15 mass % of an anionic surfactant selected from the group consisting of linear alkyl benzene sulfonic acids and salts thereof, alkane sulfonates, polyoxyethylene alkyl ether sulfate ester salts, and alpha-olefin sulfonates, (C) 0.01 to 2 mass % of a protease, and (D) 0.001 to 0.1 mass % of at least one compound selected from the group consisting of 1,2-benzoisothiazolin-3-one, 2-methyl-4-isothiazolin-3-one, 5-chloro-2-methyl-4-isothiazolin-3-one, cysteine, and 3-((4-amino-2-methylpyrimidin-5-yl)methyl)-5-(2-hydroxyethyl)-4-methylthiazol-3-ium chloride;

wherein the mass ratio of component (B)/component (A) is within a range of 0.02 to 0.8, and the mass ratio of components (D)/component (C) is within a range of 0.01 to 1.

2. The liquid detergent composition according to claim 1, further comprising (E) a calcium salt.

3. The liquid detergent composition according to claim 1, further comprising (G) an α-hydroxy-monocarboxylic acid or a salt thereof.

4. The liquid detergent composition according to claim 3, wherein the component (G) is at least one compound selected from the group consisting of lactic acid and sodium lactate.

5. The liquid detergent composition according to claim 1, further comprising (F) at least one enzyme selected from the group consisting of cellulases and lipases.

6. The liquid detergent composition according to claim 1, wherein the amount of water within the liquid detergent composition, relative to the total mass of the liquid detergent composition, is from 20 to 80 mass %.

7. The liquid detergent composition according to claim 1, wherein the combined amount of the component (A) and the component (B), relative to the total mass of the liquid detergent composition, is within a range of 11 to 70 mass %.

* * * * *